US005182733A

United States Patent [19]

Terzian

[11] Patent Number: 5,182,733

[45] Date of Patent: Jan. 26, 1993

[54] READILY SETTABLE BALANCED DIGITAL TIME DISPLAYS

[75] Inventor: Berj A. Terzian, Briarcliff Manor, N.Y.

[73] Assignee: Equitime, Inc., Briarcliff Manor, N.Y.

[21] Appl. No.: 760,817

[22] Filed: Sep. 17, 1991

Related U.S. Application Data

[63] Continuation of Ser. No. 695,444, May 3, 1991, abandoned.

[51] Int. Cl.[5] ..... G04C 19/00; G04C 9/00

[52] U.S. Cl. ..... 368/82; 368/187; 368/239

[58] Field of Search ..... 368/82-84, 368/239-242, 185-187

[56] References Cited

U.S. PATENT DOCUMENTS

| | | | |
|---|---|---|---|
| 4,264,966 | 4/1981 | Terzian | 368/82 |
| 4,271,497 | 6/1981 | Terzian | 368/82 |
| 4,483,628 | 11/1984 | Terzian | 368/82 |
| 4,627,737 | 12/1986 | Nance | 368/239 |

*Primary Examiner*—Vit W. Miska
*Attorney, Agent, or Firm*—Lucas & Just

[57] ABSTRACT

A balanced digital time display shows elapsed normal time during an initial period of each hour and thereafter remaining normal time during a subsequent period of the hour. The elapsed normal time is shown by a current hour digit followed by incrementing elapsed minute digits, and the remaining normal time is shown by the hour digit advanced to the next hour and preceded by decrementing minute digits. Means are provided for automatically converting the remaining normal time display to the equivalent elapsed normal time display whenever the display is switched from a normal time mode to a setting mode during the subsequent period of the hour and to revert the display to the equivalent remaining normal time display after setting has been completed. This sequence enables setting the display at all times while in the condition of showing elapsed normal time and avoids problems encountered in setting previous balanced digital time displays while in the condition of showing remaining normal time.

22 Claims, 1 Drawing Sheet

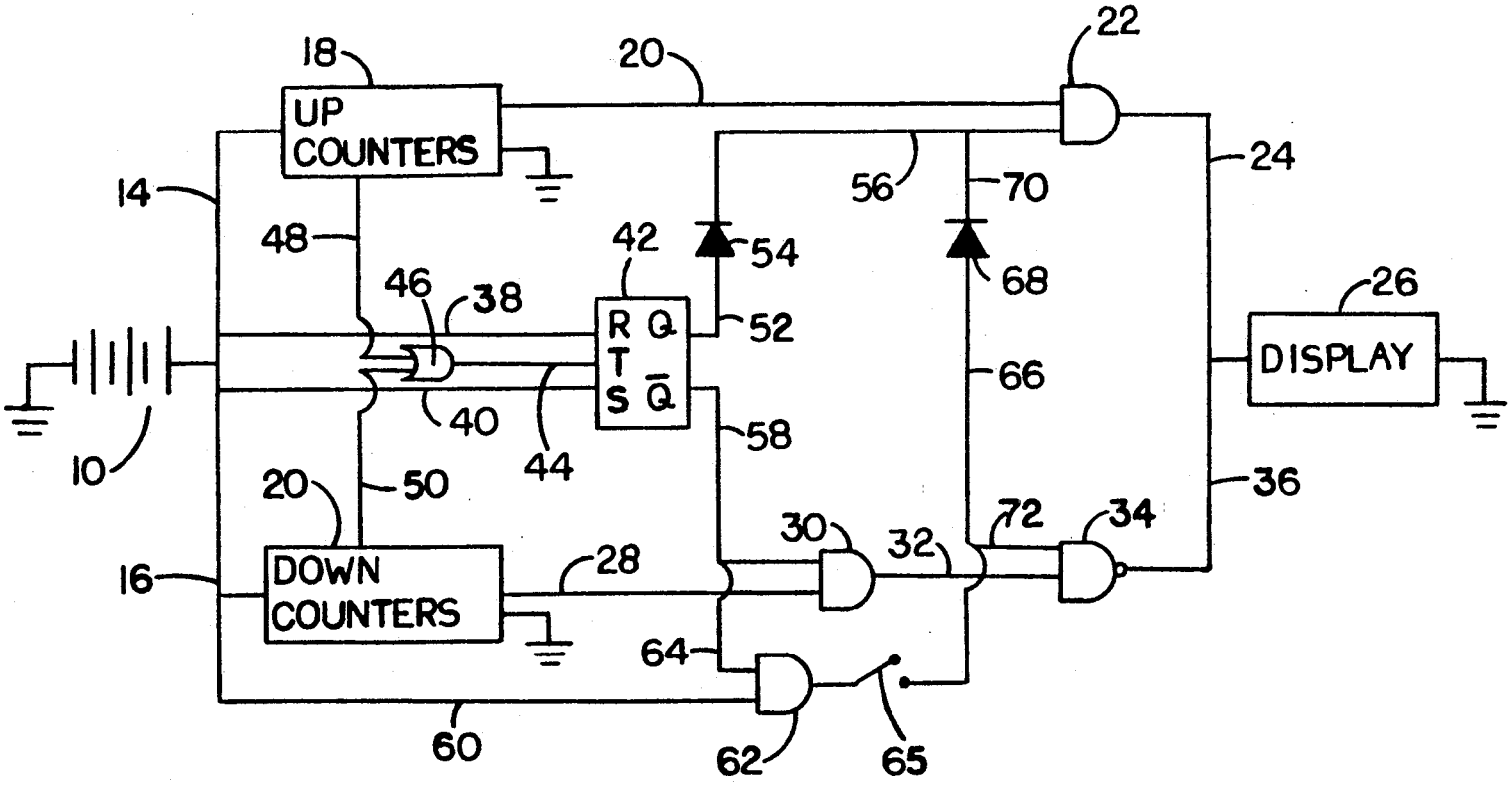
DISPLAY
UP COUNTERS
DOWN COUNTERS
R Q
T
S Q̄
10
14
16
18
20
22
24
26
28
30
32
34
36
38
40
42
44
46
48
50
52
54
56
58
60
62
64
65
66
68
70
72

READILY SETTABLE BALANCED DIGITAL TIME DISPLAYS

This is a continuation of application Ser. No. 695,444, filed May 3, 1991, now abandoned.

BACKGROUND OF THE INVENTION

1. Field of the Invention

This invention relates to balanced digital time displays which are useful for general purpose timekeeping, i.e., the timekeeping needs and practices of ordinary individuals engaged in their usual day-to-day activities.

2. Description of the Prior Art

Balanced digital time displays are described in U.S. Pat. Nos. 4,264,966, 4,271,497, 4,483,628 and 4,627,737, the disclosures of which are incorporated herein by reference. Typically these patents teach the display of both elapsed time and remaining time during the course of each hour. This is accomplished by displaying, at the beginning of an hour, centrally located current hour digits followed by incrementing elapsed minutes to the right of the hour digits and, optionally, seconds below the hour digits cycling either from zero to thirty to zero, or from zero to fifty nine, during each elapsed minute.

Approximately halfway through the hour the display switches to show remaining time, by advancing the value of the centrally located hour digit to the next hour, and by transposing and decrementing the minute digits to the left of the next hour digit, with seconds cycling either from zero to thirty to zero, or from fifty nine to zero, during each remaining minute. In effect, these displays reference time back to the onset of the current hour during the first half hour, and then reference forward the remaining time during the second half hour to the approach of the next hour, thereby providing a dual digital perspective and quantification of the intervals between the current exact time and the beginning and ending of each hour.

Such balanced digital time displays have an inherent characteristic which has caused problems when the displays are sought to be set or reset in the remaining time mode. In that mode, the display typically shows the value of each forthcoming minute and the number of seconds remaining to that minute, e.g., the twenty fifth minute and fifty nine seconds, before the next hour. That twenty fifth minute remains displayed during the interval that seconds decrement from fifty nine to zero, at the end of which the exact time shown is twenty five minutes and zero seconds before the next hour. At the very next second, the minute value automatically steps down to twenty four, and seconds resume decrementing from fifty nine to zero to count down the interval remaining to that next minute.

Thus, in the remaining time mode, the value of each exact minute and zero seconds before the next hour is seen for only one second, because the display thereafter decrements to the next remaining minute for the next fifty nine seconds, and so on. As a result, if the display is reset to an exact time announcement while showing remaining time, the value of the minute at that exact time will be seen for only the fleeting interval of one second before the minute value automatically decreases by one unit to the value of the next remaining minute, an effect which some viewers have perceived as odd or disconcerting.

Just the opposite occurs during the elapsed time mode. In that mode, as the value of each exact minute and zero seconds is reached and displayed, the minute value remains on view for the next fifty nine seconds before the display increments to the next minute. For example, if the exact time is ten minutes past the hour, the viewer will initially see ten minutes and zero seconds and will continue to see the tenth minute displayed for the next fifty nine seconds. At the next second, the value of the eleventh elapsed minute will appear with zero seconds and will remain displayed for the next fifty nine seconds, and so on.

Thus, a specific comparison of the two modes will illustrate their opposite and seemingly anomalous characteristics when exact minutes occur. Consider, for example, the exact time of six thirty four, i.e., thirty four elapsed minutes and zero seconds after the sixth hour which, in its remaining time equivalent, is twenty six minutes and zero seconds before the seventh hour. One second before this exact time, the elapsed time display would show thirty three minutes and fifty nine seconds past the sixth hour, and the equivalent remaining time display would show twenty six minutes and one second before the seventh hour. At the next second, the elapsed time display would increment to exactly thirty four minutes and zero seconds past the sixth hour, but the equivalent remaining minute value would not change—it would stay at twenty six minutes with zero seconds before the seventh hour. Only after the next second would the remaining time display decrement to twenty five minutes and fifty nine seconds before the seventh hour, while the equivalent elapsed time display would remain steady at thirty four minutes plus one second.

Accordingly, balanced digital time displays present what appears to be a lack of synchronism between the elapsed and remaining time modes because in the one second interval that elapsed minutes increment to the next higher value, there is no change in the equivalent remaining minute, whereas after the next second, while the elapsed minute value remains the same, the equivalent remaining minute decrements to the next lower value. This apparent one second mismatch between the elapsed and remaining time modes exacerbates the previously discussed difficulties arising from the fact that setting to an exact elapsed minute retains the resulting minute value for the next fifty nine seconds, but setting to an equivalent exact remaining minute loses the resulting minute value after only one more second, thus accentuating the seemingly asynchronous anomalies between the two modes.

Confronted with these problems, certain workers in the art have resorted to a solution which has left much to be desired. Specifically, in producing prototype wristwatches incorporating the teachings of U.S. Pat. No. 4,627,737, such workers artificially advanced real time by one second at the moment of transition from the elapsed to remaining time modes. In other words, after reaching thirty minutes and twenty nine seconds past the current hour, instead of incrementing the display to thirty minutes and thirty seconds at the next second, the display was programmed to skip over that value and jump ahead to twenty nine minutes and twenty nine seconds before the next hour.

The idea behind this one second advance of real time was to cause both incrementing of elapsed minutes and decrementing of equivalent remaining minutes to occur at the same point in time, thereby eliminating the apparent mismatch and asynchronism between the elapsed and remaining time modes. In fact, this result was achieved, which will be understood by reference again to the previously discussed comparative specific example. By advancing the remaining time display ahead by one second, for example, at thirty three minutes and fifty nine seconds past the sixth hour, the equivalent remaining time display showed twenty six minutes and zero seconds before the seventh hour, instead of the actual real time of twenty six minutes and one second before the seventh hour. After the next second, the elapsed time display incremented to thirty four minutes and zero seconds past the sixth hour, whereas the equivalent remaining time display decremented to twenty five minutes and fifty nine seconds before the seventh hour, instead of the actual real time of twenty six minutes and zero seconds. Thus, the two display modes were caused to undergo simultaneous transitions when stepping up and down from minute to minute during the remaining time period, and the apparently anomalous characteristics and mismatch between the elapsed and remaining time modes during this period were eliminated.

At least two undesirable effects resulted from the above described solution. First, since the display was caused to move ahead by one second from exact real time beginning at the transition from elapsed to remaining time, it thereafter showed time that was correspondingly incorrect by that amount for the balance of the remaining time period. In fact, at the next transition from remaining time to elapsed time, i.e., at the commencement of the next hour, it became necessary to insert a corresponding one second delay of real time to compensate for and eliminate the previous one second advance, thereby restoring the display to the correct time. Thus, in the prototype wristwatches, the time was always incorrect, i.e., too fast by one second, throughout the remaining time mode, an obviously undesirable condition, particularly for a digital form of time display which is expected to show time with exceptional exactness and accuracy.

A second problem was that by maintaining the one second advance of real time throughout the period of the remaining time mode, the display always automatically reset to the next remaining minute and fifty nine seconds whenever it was set to any exact minute time announcement. This came about because the display was always one second too fast and whenever setting was attempted to an exact minute, the true value of each such minute and zero seconds had already been displayed and passed one second earlier. For example, in resetting the display to twenty four minutes before the next hour, at the moment of an announcement of that exact time (in terms of its equivalent thirty six minutes past the current hour), the viewer instead saw twenty three minutes and fifty nine seconds before the next hour. Thus, the viewer could never synchronize the display to correct exact values of specific remaining minutes and zero seconds before the next hour in the remaining time mode, but instead always saw the value of the next remaining minute and fifty nine seconds, whenever the display was reset during the second half hour. This anomaly has been perceived as also, if not more, strange and disconcerting than the difficulties it was designed to solve and has seriously complicated the setting or resetting of balanced digital time displays.

SUMMARY OF THE INVENTION

The present invention provides a simple and effective solution to the above discussed problems. This solution is based upon the realization that when a balanced digital time display is switched from a normal time mode to a setting mode, this is only a temporary condition of relatively short duration which ends upon completion of the setting procedure. Therefore, if such switching occurs when the display is showing remaining normal time, i.e., a next hour digit preceded by decrementing remaining minutes, there is no reason or necessity for maintaining the display in that condition. On the contrary, in accordance with the present invention, the display is automatically converted to the equivalent elapsed normal time, i.e., the current hour digit followed by incrementing elapsed minutes. After setting has been completed, the display is automatically returned to the equivalent remaining normal time when switched back to the normal time mode.

Thus, in the balanced digital time displays of this invention, there are means for counting current hours and incrementing elapsed minutes, means for counting next hours and decrementing remaining minutes, switching means for selectively switching the display from a normal time mode to a setting mode and back to the normal time mode, and means responsive to said switching to the setting mode, when carried out while the display is showing remaining normal time, for converting the display into the then equivalent elapsed normal time to enable setting the display in that condition. After completion of setting, when the switching means is again operated to switch the display back to the normal time mode, the responsive means also reacts to revert the display into the then equivalent remaining time, shown by the next hour digit preceded b decrementing remaining minutes.

The foregoing provides a balanced digital display and a method of facilitating the same in which setting is always performed while the display is in the condition of showing elapsed normal time, regardless of whether setting occurs during the first or second half hour. Preferably, during the first half hour the display shows elapsed normal time, which condition is maintained when the display is switched to the setting mode and thereafter back to normal time during this period. Preferably, during the second half hour the display shows remaining normal time, which condition is automatically converted to equivalent elapsed time when the display is switched to the setting mode and thereafter is automatically reverted to equivalent remaining time when the display is switched back to the normal time mode during this period. Therefore, unlike previous balanced digital time displays, when using the displays of this invention, the viewer is never required to set the display when it is in the condition of showing remaining normal time.

As a result, the previously discussed problems are eliminated. With setting always performed when the display is showing elapsed normal time, the display will consistently reset at all exact minute announcements to the values of such minutes, with zero seconds, and such minute values will be retained for intervals of fifty nine seconds throughout the setting period, rather than decrementing at the next second, as in the previously discussed balanced digital time displays. Also, the apparent one second mismatch and asynchronism between the elapsed and remaining time displays will not occur.

Other benefits are also gained from the present invention. Since prerecorded exact time announcements are invariably given in terms of elapsed time throughout each hour, i.e., the current hour digit followed by elapsed minutes and seconds, the viewer need not mentally translate such announcements to equivalent remaining time when setting or checking accuracy of the displays of this invention during the second half hour, as was required with the previous balanced digital time displays. Also, when the viewer sets or checks the displays of this invention during the second half hour, the display will twice juxtapose equivalent remaining and elapsed normal time displays, initially as a result of switching to the setting mode and again when switching back to the normal time mode. For those attracted to the sequences of balanced digital time displays, these juxtapositions will serve as periodic graphic reminders of the contrast and advantages of such balanced time displays over conventional digital displays.

BRIEF DESCRIPTION OF THE DRAWING

Further details of the invention will be understood by reference to the accompanying drawing which shows an exemplary logic circuit diagram for implementing the invention in conjunction with the previously mentioned prototype wristwatches made in accordance with U.S. Pat. No. 4,627,737.

In the drawing battery 10 supplies power through leads 14 and 16 to UP COUNTERS 18 and DOWN COUNTERS 20, respectively. These counters provide electronic output signals corresponding, respectively, to incrementing hours, minutes and seconds and to complementary equivalent decrementing hours, minutes and seconds, in the manner incorporated in the previous prototype wristwatches. The output of the UP COUNTERS 18 is connected through lead 20, AND gate 22 and lead 24 to the time display elements signified by DISPLAY 26. The output of the DOWN COUNTERS 20 is connected through lead 28, AND gate 30, lead 32, NAND gate 34 and lead 36 also to the DISPLAY 26. Thus, when the display elements of DISPLAY 26 are energized by the signals supplied through lead 24, the DISPLAY shows elapsed normal time, i.e., the current hour followed by elapsed minutes, with elapsed seconds preferably displayed below the hour, as previously described. Conversely, when the display elements of DISPLAY 26 are energized by the signals supplied through lead 36, the DISPLAY shows remaining normal time, i.e., the next hour, preceded by remaining minutes, with remaining seconds also preferably displayed below the hour.

Leads 38 and 40 connect battery 10 to the R and S terminals of a toggle type RST flip flop 42. Lead 44 connects the output of OR gate 46 to the T terminal of flip flop 42. Lead 48 connects an output terminal of UP COUNTERS 18 to one input of OR gate 46. Lead 50 connects an output terminal of DOWN COUNTERS 20 to the other input of OR gate 46.

Lead 52, diode 54 and lead 56 connect the output terminal Q of flip flop 42 to AND gate 22. Thus, these elements, together with lead 20, provide the inputs to AND gate 22. Similarly, lead 58 connects the output terminal $\overline{Q}$ of flip flop 42 to AND gate 30, and these elements, together with lead 28, provide the inputs to this gate.

Branch lead 60 connects lead 16 and battery 10 to AND gate 62. Leads 58 and 64 also connect the output terminal $\overline{Q}$ of flip flop 42 to AND gate 62 and these elements, together with lead 60, provide the inputs to this gate. The output of AND gate 62 is connected to a manually operable switch 65 for switching the circuit from a normal time mode to a setting mode when the switch is closed, and to return the display to the normal time mode from the setting mode when the switch is opened.

Branch lead 66, diode 68 and lead 70 connect switch 65 to lead 56 and thus provide an alternate input to AND gate 22 when switch 65 is closed. Lead 72 connects switch 65 and lead 66 also to NAND gate 34 and, together with output lead 32 from AND gate 30, provides input to gate 34.

The operation of the above described circuit will now be explained. At start up, the normalized circuit will be at 12 AM and zero minutes and seconds, as in the previous prototype wristwatches. This condition of zero minutes and seconds in the UP and DOWN COUNTERS 18 and 20 is applied through leads 48 and 50, OR gate 46 and lead 44 to the T terminal of flip flop 42 to set the flop and thus provide output at its Q terminal through lead 52, diode 54 and lead 56 to AND gate 22. The output signals from UP COUNTERS 18 are simultaneously inputted to AND gate 22. Therefore, gate 22 is in conducting condition and the UP COUNTER signals are transmitted through lead 24 to the DISPLAY 26 which displays incrementing elapsed normal time. Diode 68 prevents the output of flip flop 42 from reaching NAND gate 34 through lead 70, diode 68 and leads 66, 72. Therefore, there is no output from NAND gate 34. Also, during this period, there is no output from output terminal $\overline{Q}$ of flip flop 42. Consequently, AND gate 30 is not conductive, and the output signals of DOWN COUNTERS 20, which are also inputted to gate 30, are suppressed from passing through to the DISPLAY 26.

Preferably, when UP COUNTERS 18 have incremented to exactly thirty minutes and thirty seconds past the current hour, this signal is applied through lead 48, OR gate 46 and lead 44 to the T terminal of flip flop 42, thereby causing it to toggle to its reset condition. As a result, the output at the Q terminal ceases, AND gate 22 stops conducting and the output signals of UP COUNTERS 20 are suppressed from reaching the DISPLAY elements 26. Simultaneously, there is output at the $\overline{Q}$ terminal of flip flop 42 which is applied through lead 58 to AND gate 30. The output signals from DOWN COUNTERS 20 are also simultaneously applied to AND gate 30. Therefore, this gate conducts and the DOWN COUNTER output signals are transmitted through lead 32, NAND gate 34 and lead 36 to the time DISPLAY 26 which begins showing decrementing remaining normal time.

When the DOWN COUNTERS 20 reach the condition of zero remaining minutes and seconds, i.e., the beginning of the next hour, this signal is applied through lead 50, OR gate 46 and lead 44 to the T terminal of flip flop 42, causing it to toggle to its set condition. This ceases output at the $\overline{Q}$ terminal, reestablishes output at the Q terminal, and restarts the same cycle of displaying incrementing elapsed normal time at the DISPLAY 26, as the circuit enables AND gate 22 to transmit the corresponding output signals from UP COUNTERS 48 and disables AND gate 30 to suppress the decrementing output signals from the DOWN COUNTERS 20 for the next thirty minutes and thirty seconds. The foregoing explains the operation of the circuit during display of normal elapsed and remaining time in the manner of the previously cited patents which teach balanced digital time displays.

Assume now that the circuit is in the condition of displaying elapsed normal time, i.e., AND gate 22 is conducting and AND gate 30 is not conducting. If switch 65 is closed to switch the circuit into the setting mode, there will be no current flow through AND gate 62 because there is no output from the $\overline{Q}$ terminal of flip flop 42. Therefore, there is no input through leads 58 and 64 to AND gate 62 and this gate will remain nonconductive. This enables setting the time DISPLAY 26 while its elements are showing elapsed normal time. As previously explained, this permits setting the display to an exact minute announcement and retaining that minute value for the next fifty nine seconds, without the problems associated with setting the display when it is showing remaining normal time.

Upon opening switch 65 to return to the normal time mode, the DISPLAY 26 will continue to show elapsed normal time until flip flop 42 toggles to its reset condition at thirty minutes and thirty seconds past the current hour, as previously described.

Assume now that as a result of such toggling the circuit is in the condition of showing remaining normal time, i.e., AND gate 22 is not conducting and AND gate 32 and NAND 34 are conducting to transmit the decrementing output signals from DOWN COUNTERS 20 to DISPLAY 26. Assume further that switch 65 is closed to switch the circuit into the setting mode. Since there is now input to AND gate 62 from the $\overline{Q}$ terminal of flip flop 42 through leads 58, 64, together with input from battery 10 and leads 16 and 60, this gate conducts and power is applied through switch 65, lead 66, diode 68 and leads 70, 56 to AND gate 22, as well as through lead 72 to NAND gate 34. As a result, gate 22 is enabled to transmit the output signals of UP COUNTERS 18 through leads 20, 24 to the DISPLAY 26. Simultaneously, NAND gate 34 stops conducting since its two inputs from leads 32 and 72 are present together, and consequently the output signals from the DOWN COUNTERS 20 are suppressed from passing through and reaching DISPLAY 26. Diode 54 prevents the power in lead 66, diode 68 and leads 70, 56 from interfering with or affecting the condition of flip flop 42. The net result is that the DISPLAY 26 is converted from displaying remaining normal time to showing the complementary equivalent elapsed normal time. This enables setting the display in that condition even though normal time is in the second half of the hour. Thus, the display can be just as readily set to an exact minute announcement as in the first thirty and one half minutes of the hour, without the previously described problems associated with setting the display when it is showing remaining normal time.

Upon completion of the setting procedure and subsequent opening of switch 65, power through lead 66, diode 68 and leads 70, 56 is discontinued to AND gate 22, as well as to NAND gate 34 through lead 72. As a result, AND gate 22 is rendered nonconducting, NAND gate 34 becomes conducting, the incrementing output signals from UP COUNTERS 18 are suppressed, and the decrementing output signals from DOWN COUNTERS 20 resume passing through lead 28, AND gate 30, lead 32, NAND gate 34 and lead 36 to show once again equivalent remaining normal time at DISPLAY 26.

The invention has now been described in terms of its operative principles and an illustrative embodiment. It provides effective solutions to the problems of the prior art discussed above and substantial simplification of the setting of balanced digital time displays. It will be understood that the invention may be practiced as described above and in all other embodiments or variations that will be obvious to those skilled in the art. Accordingly, it will be understood that this invention is not limited to the illustrative embodiment but encompasses the subject matter delineated by the following claims and all equivalents thereof.

The following is claimed:

1. In a balanced digital time display, wherein normal time is displayed by a current hour digit followed by incrementing elapsed minute digits and by a next hour digit preceded by decrementing remaining minute digits during, respectively, initial and subsequent periods of the same current hour, a modification for facilitating setting of the display which comprises:

(a) means for counting current hours and incrementing elapsed minutes;

(b) means for counting next hours and decrementing remaining minutes;

(c) means for selectively switching the display from a normal time mode to a setting mode and back to the normal time mode; and (d) means responsive to said switching to the setting mode, when carried out while the display shows a next hour digit preceded by decrementing remaining minutes, for converting the display into the then equivalent elapsed normal time shown by the current hour digit followed by incrementing elapsed minutes to enable setting the display to elapsed normal time, and also responsive to said switching back to the normal time mode for reverting the display into the then equivalent remaining normal time shown by the next hour digit preceded by decrementing remaining minutes.

2. A display as in claim 1 wherein said means for converting and reverting includes first gating means for connecting the output of the means for counting current hours and incrementing elapsed minutes to display means for displaying such time during a predetermined initial period of each current hour, and second gating means for connecting the output of the means for counting next hours and decrementing remaining minutes to the display means for displaying such time during a predetermined subsequent period of the same current hour.

3. A display as in claim 2 in which the first gating means is an AND gate and the second gating means is an AND gate the output of which is inputted to a NAND gate the output of which is connected to the display means.

4. A display as in claim 3 which further includes means for enabling the first AND gate during the predetermined initial period of each current hour and means for enabling the second AND and NAND gates during the predetermined subsequent period of the same current hour.

5. A display as in claim 4 in which the enabling means for the first AND gate is power supplied from one output terminal of a flip flop and inputted together with the output of the means for counting current hours and incrementing elapsed minutes to the first AND gate, and the enabling means for second AND and NAND gates is power supplied from another output terminal of the flip flop and inputted together with the output of the means for counting next hours and incrementing remaining minutes to the second AND and NAND gates.

6. A display as in claims 1, 2, 3, 4, or 5 wherein said means for selectively switching includes means operable for switching the display from the normal time mode into a setting mode and for switching back from the setting mode into the normal time mode at any selected time during each current hour.

7. A display as in claim 5 in which the switching means comprises a third AND gate the inputs of which include power supplied from the other output terminal of the flip flop and power supplied from a power source together with a manually actuatable switch connected to the output of the third AND gate, whereby when the switch is actuated to switch from the normal time mode to the setting mode the third AND gate is enabled and power outputted from it is transmitted as an alternate input to the first AND gate and to the NAND gate, and when the switch is reactuated to switch back from the setting mode to the normal time mode the third AND gate is disabled to terminate the alternate power inputs to the first AND gate and the NAND gate.

8. A display as in claim 7 in which when the switching means is actuated while power is outputted from the one terminal but not from the other terminal of the flip flop, the third AND gate remains disabled and the display means displays elapsed time while in the setting mode.

9. A display as in claim 7 in which when the switching means is actuated while power is outputted from the other terminal but not the one terminal of the flip flop, the third AND gate is enabled to provide alternate power input to the first AND gate, which enables same to transmit the current hour and incrementing elapsed minutes to the display means, as well as alternate power input to the NAND gate which is disabled by simultaneous input of the output of the second AND gate, to suppress the output of the means for counting next hours an decrementing remaining minutes transmitted by the second AND gate from reaching the display means, whereby the display means displays elapsed normal time while in the setting mode.

10. A display as in claim 9 in which when the switch is reactuated to switch back from the setting mode to the normal time mode, the third AND gate is disabled, the alternate power input to the first AND gate is discontinued to disable this gate, which suppresses the output of the means for counting next hours and incrementing minutes from reaching the display means, the alternate power input to the NAND gate is discontinued to enable this gate to transmit to the display means the output of the means for counting next hours and decrementing remaining minutes transmitted by the second AND gate, whereby the display means reverts to displaying remaining normal time.

11. A display as in claim 5, which further includes means for setting the flip flop to provide power output from its one terminal but not the other terminal during the predetermined initial period of each current hour and for resetting the flip flop to provide power output from its other terminal but not the one terminal during the predetermined subsequent period of the same current hour.

12. A display as in claim 11 in which the means for setting and resetting the flip flop includes an OR gate one input to which is a signal outputted from the means for counting next hours and decrementing remaining minutes at the end of the predetermined subsequent period and the simultaneous beginning of the predetermined initial period of each current hour, and another input to which is a signal outputted from the means for counting current hours and incrementing elapsed minutes at the end of the predetermined initial period and simultaneous beginning of predetermined subsequent period of the current hour, the resulting outputs of the OR gate being inputted to the flip flop to set and reset it, respectively, during the predetermined initial and subsequent periods of the same current hour.

13. A display as in claim 12 in which the predetermined initial period is the first thirty minutes and thirty seconds after the beginning of each current hour and the predetermined subsequent period is the remaining time during the same current hour.

14. A method of facilitating setting of the display in a balanced digital time display wherein a current hour digit followed by incrementing elapsed minute digits shows elapsed normal time and a next hour digit preceded by decrementing remaining minutes shows remaining normal time, said method comprising the steps of:

(a) maintaining the display in a normal time mode showing elapsed normal time during an initial period of an hour and remaining normal time during a subsequent period of the hour;

(b) switching the display from the normal time mode to a setting mode; and (c) converting the display from showing remaining normal time to showing equivalent elapsed normal time when the switching occurs during the subsequent period of the hour.

15. A method as in claim 14 which further includes the steps of switching the display back from the setting mode to the normal time mode, and reverting the display from showing elapsed normal time to showing equivalent remaining normal time when the switching back occurs during the subsequent period of the hour.

16. A method as in claim 14 which further includes the step of converting the display automatically upon switching it from the normal time mode to the setting mode.

17. A method as in claim 15 which further includes the step of reverting the display automatically upon switching it back from the setting mode to the normal time mode.

18. A method as in claim 14 which further includes the step of setting the display after converting it from showing remaining normal time to showing equivalent elapsed normal time.

19. A method as in claim 18 which further includes the step of setting the display by synchronizing it to an exact time announcement.

20. A method as in claim 15 which further includes the step of maintaining the display in the condition of showing elapsed normal time when switching it from the normal time mode to the setting mode and when switching it back from the setting mode to the normal time mode during the initial period of the hour.

21. A method as in claim 14 which further includes the step of showing incrementing elapsed seconds during each minute of the initial period of the hour.

22. A method as in claim 14 which further includes the step of showing decrementing remaining seconds during each minute of the subsequent period of the hour.

* * * * *

UNITED STATES PATENT AND TRADEMARK OFFICE

CERTIFICATE OF CORRECTION

PATENT NO. : 5,182,733

DATED : January 26, 1993

INVENTOR(S) : Berj A. Terzian

It is certified that error appears in the above-identified patent and that said Letters Patent is hereby corrected as shown below:

Column 4, line 36, change "b" to --by--.

Column 9, line 3 (claim 6), change the dependency from "claims 1, 2, 3, 4, or 5" to --claim 5--.

Column 9, line 9 (claim 7), change the dependency from "claim 5" to --claims 5 or 6--.

Column 9, line 39 (claim 9), change "an" to --and--.

Signed and Sealed this

Twenty-third Day of November, 1993

*Attest:*

Bruce Lehman

BRUCE LEHMAN

*Attesting Officer*

*Commissioner of Patents and Trademarks*